US006176113B1

(12) United States Patent
White, III

(10) Patent No.: US 6,176,113 B1
(45) Date of Patent: Jan. 23, 2001

(54) INFLATABLE DEVICE FOR REMOVING DENTS IN COMPONENTS OF VEHICLES

(76) Inventor: Harold J. White, III, 193 Center St., Cleveland, NY (US) 13042

( * ) Notice: Under 35 U.S.C. 154(b), the term of this patent shall be extended for 0 days.

(21) Appl. No.: 09/505,285

(22) Filed: Feb. 16, 2000

Related U.S. Application Data

(60) Provisional application No. 60/120,783, filed on Feb. 19, 1999.

(51) Int. Cl.[7] ..... B21D 22/10
(52) U.S. Cl. ..... 72/54; 72/705
(58) Field of Search ..... 72/54, 63, 705

(56) References Cited

U.S. PATENT DOCUMENTS

| | | | | |
|---|---|---|---|---|
| 2,804,118 | | 8/1957 | Bayerkohler | 72/392 |
| 3,712,106 | | 1/1973 | Holsapple et al. | 72/309 |
| 4,171,631 | | 10/1979 | Butts | 72/54 |
| 4,453,391 | | 6/1984 | McGee | 72/54 |
| 4,817,412 | * | 4/1989 | Hinson | 72/705 |
| 5,119,667 | | 6/1992 | Hollis et al. | 72/453.16 |
| 5,671,629 | * | 9/1997 | Valyi | 72/63 |

FOREIGN PATENT DOCUMENTS

| | | | | |
|---|---|---|---|---|
| 266517 | * | 4/1989 | (DE) | 72/705 |
| 61-23523 | * | 2/1986 | (JP) | 72/705 |
| WO 94/26649 | | 11/1994 | (WO) . | |

* cited by examiner

*Primary Examiner*—Ed Tolan
(74) *Attorney, Agent, or Firm*—Richard C. Litman

(57) ABSTRACT

An inflatable device for simply and efficiently repairing a dent, crease, or other surface irregularity in a component of a vehicle, or, alternatively, for simply and efficiently supporting, raising or moving an object to a desired position. The device includes an accordion-like, inflatable air vessel and an air hose assembly that is adapted for attaching to the vessel for introducing air under pressure into the vessel for expanding the vessel. The device can be manufactured in a variety of shapes and sizes for different specific uses. Additionally, a separate top, which can also be manufactured in a variety of shapes and sizes, may be applied over a part of the vessel for different specific uses. The device, in its deflated or flattened position, is placed beneath or beside the vehicular component to be repaired. The device is then inflated to force the dent, crease or other surface irregularity outwardly back toward its original contour. Alternatively, the device, in its deflated or flattened position, is placed beneath or beside the object to be supported, raised or moved. The device is then inflated, thereby supporting, raising or moving the object to a desired position.

8 Claims, 7 Drawing Sheets

INFLATABLE DEVICE FOR REMOVING DENTS IN COMPONENTS OF VEHICLES

CROSS-REFERENCE TO RELATED APPLICATION

This application claims the benefit of U.S. Provisional Patent Application Ser. No. 60/120,783, filed Feb. 19, 1999.

BACKGROUND OF THE INVENTION

1. Field of the Invention

The present invention generally relates to a vehicular body repair device or, alternatively, to a lifting device. More specifically, the invention is a device which uses air under pressure to remove a dent, crease, or other surface irregularity in a component of a vehicle, or, alternatively, to support, raise or move an object to a desired position.

2. Description of Related Art

A number of practices and devices have been devised for restoring components of vehicles that acquired dents, creases or other surface irregularities from vehicular accidents or other events, and for supporting, raising or moving objects to desired positions. The related art is represented by the following patents of interest.

U.S. Pat. No. 2,804,118, issued on Aug. 27, 1957 to Irvin L. Bayerkohler, describes a pneumatic bellows type jack for straightening automobile body parts. The jack includes an air hose and a bellows situated between a rear base plate and a front presser or dolly plate. The bellows has multiple expansible and contractile air chambers made of a material such as vulcanized rubber. The chambers are detachable and may include several chambers attached together. The front presser or dolly plate is attachable to and detachable from the front air chamber by a screw-type means, is preferably circular, and may have a contoured front face suitable for pressing a correspondingly contoured body part into shape. The deflated, inflatable jack is placed between the inner surface of a damaged portion and against an unyielding member in the vehicle. The jack is then inflated with sufficient air pressure to force the portion back toward its original contour.

U.S. Pat. No. 3,712,106, issued on Jan. 23, 1973 to Olen W. Holsapple et al., describes a tool for reshaping deformed panels of automobiles comprising a vacuum cap for gripping a dented panel and a force transmitting means coupled to the vacuum cup to apply an external operating force to pull the dented portion, with the cup, outwardly back toward its original contour.

U.S. Pat. No. 4,171,631, issued on Oct. 23, 1979 to Clifford L. Butts, describes a method of quickly restoring a deformed outer panel of a vehicle to its original contour comprising the steps of placing a deflated, inflatable air bag between the inner surface of the indented panel and against an unyielding member in the vehicle, then inflating the air bag with sufficient air pressure to force the indented panel outwardly back toward its original contour, and, if necessary, hammering out any irregularity in the panel while the air bag still remains inflated. U.S. Pat. No. 4,453,391, issued on Jun. 12, 1984 to Patrick J. McGee, describes a device which performs similar functions to those functions disclosed by the Butts patent.

U.S. Pat. No. 5,119,667, issued on Jun. 9, 1992 to Freddy C. Hollis et al., describes a pneumatic hammer for use on auto body surfaces to remove bumps and dents. The hammering force is developed by a piston that operates in an air cylinder.

International Patent document WO 94/26649, published on Nov. 24, 1994, describes a lifting cushion for supporting, raising or moving objects. The cushion includes an inflatable envelope, a first layer and a second layer. The envelope includes two rectangular sheets of woven polyaramid cloth. The cushion, in its flattened condition, is placed beneath the object to be raised. The cushion is then inflated, thereby raising the object. If further lift is required, one or more additional cushions may be inserted one above the other and subsequently inflated to provide a required degree of lift of the object.

The prior art fails to teach a device or practice which enables an operator to remove various-shaped or various-sized dents, creases or other surface irregularities in the components of vehicles from various-shaped or various-sized areas proximate to the components' locations, or alternatively, to support, raise or move objects to desired positions proximate the objects' locations. The instantly disclosed device, unlike the devices or practices taught in the prior art, is neither bulky nor made from an excessive number of parts. Because the instantly disclosed device can be transformed to various shapes or sizes, it is easily applicable to various-shaped or sized areas proximate a components' or objects' location. None of the above inventions and patents, taken either singly or in combination, is seen to describe the instant invention as claimed.

SUMMARY OF THE INVENTION

The inflatable device according to the invention, for simply and efficiently repairing a dent, crease, or other surface irregularity in a component of a vehicle, or alternatively, for simply and efficiently supporting, raising or moving an object to a desired position, includes an accordion-like, inflatable air vessel and an air hose assembly adapted to attach to the vessel for introducing pressurized air into the vessel, thereby expanding the vessel. The device can be manufactured in a variety of shapes and sizes for different specific uses. Additionally, a separate top portion, which can also be manufactured in a variety of shapes and sizes, may be attached or applied to the vessel.

When in use, the inflatable device in its deflated or flattened position, is placed beneath or beside the vehicular component needed to be repaired. The device is then inflated to force the dent, crease or other surface irregularity outwardly back toward its original contour. Alternatively, the device, in its deflated or flattened position, is placed beneath or beside the object to be supported, raised or moved. The device is then inflated, thereby supporting, raising or moving the object to a desired position.

Accordingly, it is a principal object of the invention to provide an inflatable device for removing various-shaped or various-sized dents, creases or other surface irregularities in the components of vehicles from a variety of shaped or sized areas located approximate to the components' locations.

It is another object of the invention to provide an inflatable device for supporting, raising or moving objects to desired positions from a variety of shaped or sized areas located approximate to the objects' locations.

It is an object of the invention to provide improved elements and arrangements thereof in an inflatable device for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is an inflatable device for removing a dent, crease, or other surface irregularity in a component of a vehicle. Alternatively, an inflatable device according to the invention may be used for supporting, raising, or moving an object to a desired position. With reference now to the drawings thereof, an inflatable device embodying the principles and concepts of the present invention will be described. The present invention is comprised of a plurality of components. Such components in their broadest context include an accordian-like, inflatable air vessel and an air hose assembly. These components are individually configured and correlated with respect to each other so as to attain the desired objective.

Figure 1:
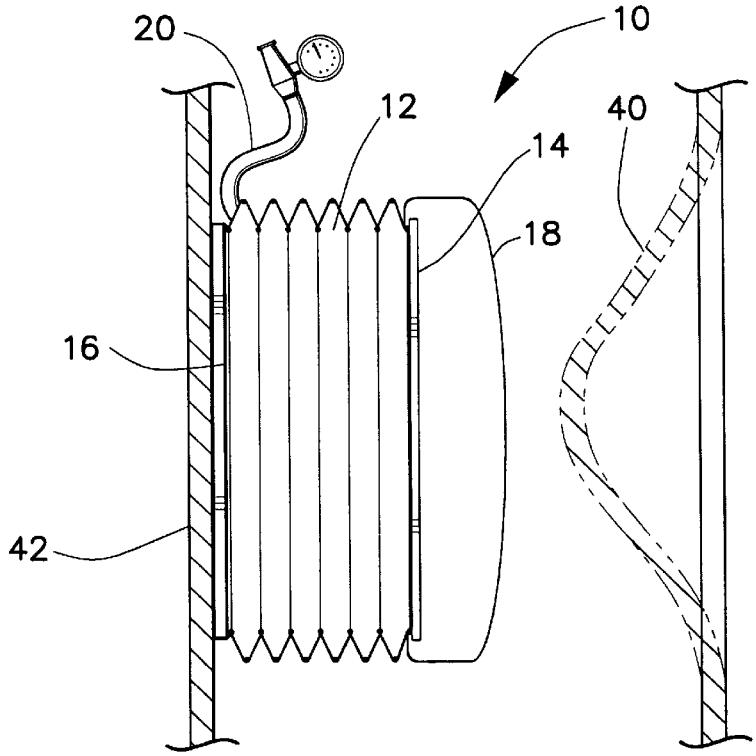
FIG. 1 is an environmental, perspective side view of an inflatable device, according to the present invention, in a deflated configuration, in an embodiment with a top.
Figure 2:
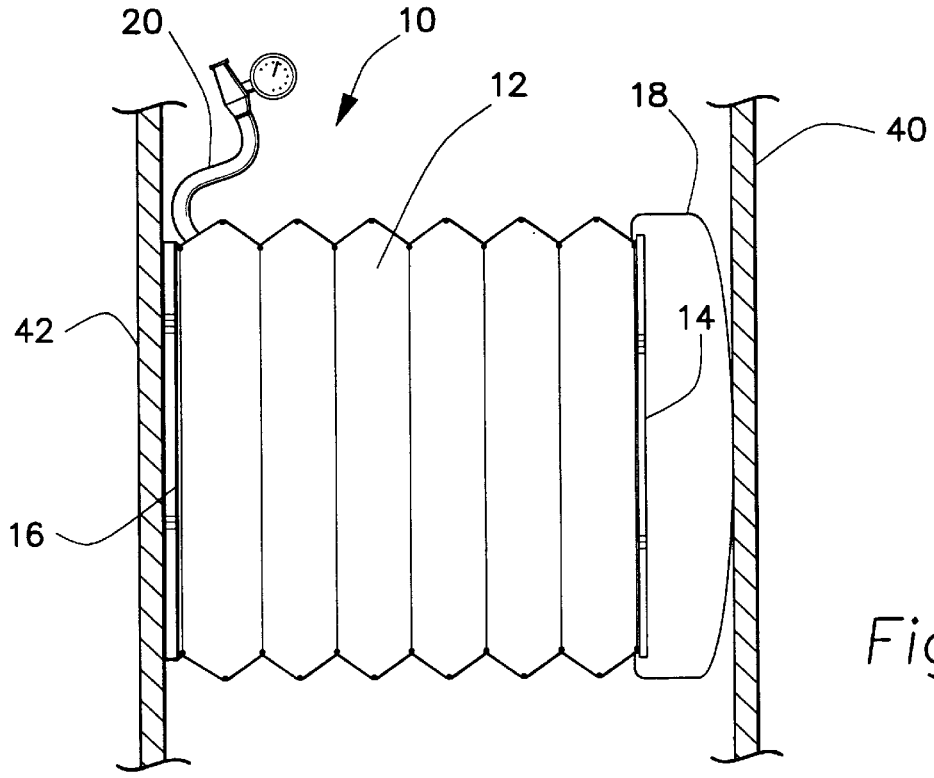
FIG. 2 is a perspective side view of an inflatable device, according to the present invention, in an inflated configuration, in an embodiment with a top.
Figure 3:
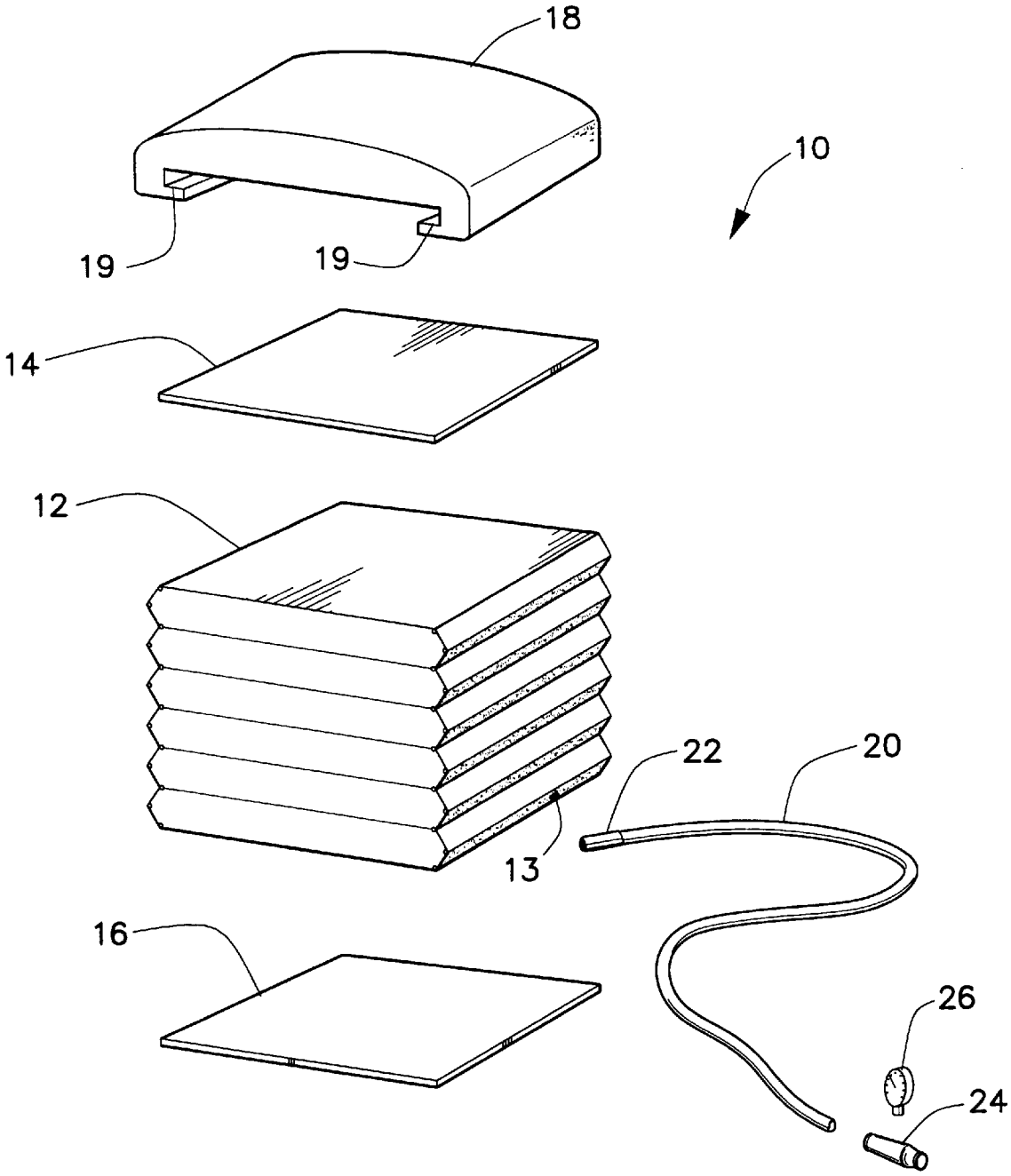
FIG. 3 is an exploded side view of an inflatable device, according to the present invention, in an inflated configuration, in an embodiment with a top.

One type of inflatable device according to the invention is shown in FIGS. 1–3 generally by reference character 10. FIG. 1 illustrates the inflatable device 10 in a deflated configuration. FIG. 2 illustrates the inflatable device 10 in a fully inflated configuration. The inflatable device 10 includes an accordian-like, inflatable air vessel and an air hose assembly 20 adapted for attaching to the inflatable air vessel 10 for introducing air under pressure into the inflatable air vessel 10 for expanding the inflatable air vessel 10. The inflatable air vessel 10 comprises a first planar end surface 14, a second planar end surface 16, and an accordian-like middle section 12. The first surface 14 of the inflatable air vessel 10 is made of a layer having a suitable thickness of a suitably resilient material, such as a vulcanized rubber composition or the like, having sufficient strength and rigidity to press forcefully against a dent, crease, or other surface irregularity 40 or, alternatively, against an object, when sufficient air under pressure is introduced into the inflatable air vessel. The first surface 14 of the inflatable air vessel 10 preferably has a tongue formation which may be used, if necessary, for attaching a separate top portion 18 to the first surface 14. The second surface 16 of the inflatable air vessel 10 is substantially the same as the first surface 14, wherein it is made of a layer having a suitable thickness of a suitably resilient material, such as a vulcanized rubber composition or the like, having sufficient strength and rigidity to press forcefully against a dent, crease, or other surface irregularity 40 or, alternatively, against an object, when sufficient air under pressure is introduced into the inflatable air vessel 10. Preferably, the first and second surfaces 14,16 of the inflatable air vessel 10 are each formed from material such as plastic, vulcanized rubber, metal, or the like.

The middle section 12 of the inflatable air vessel 10 is made of a layer of suitable thickness of a suitably resilient material having enough strength and flexibility to expand or contract like an accordion when sufficient air under pressure is introduced into or withdrawn from the inflatable air vessel 10. Preferably, the middle section 12 of the inflatable air vessel 10 is formed from material such as vulcanized rubber or the like. The middle section 12 is interposed between the first surface 14 of the inflatable air vessel and the second surface 16 of the inflatable air vessel for expanding, for engaging the first surface 14 of the inflatable air vessel 10 against a dent, crease, or other surface irregularity 40 or, alternatively, against the object, and for engaging the second surface 16 of the inflatable air vessel 10 against an unyielding member 42 in a vehicle or, alternatively, against another object or structure proximate to the first surface 16 when sufficient air under pressure is introduced into the inflatable air vessel 10. Additionally, the first surface 14, the middle section 12, and the second surface 16, respectively, of the inflatable air vessel 10 are coaxially arranged.

Figure 4:
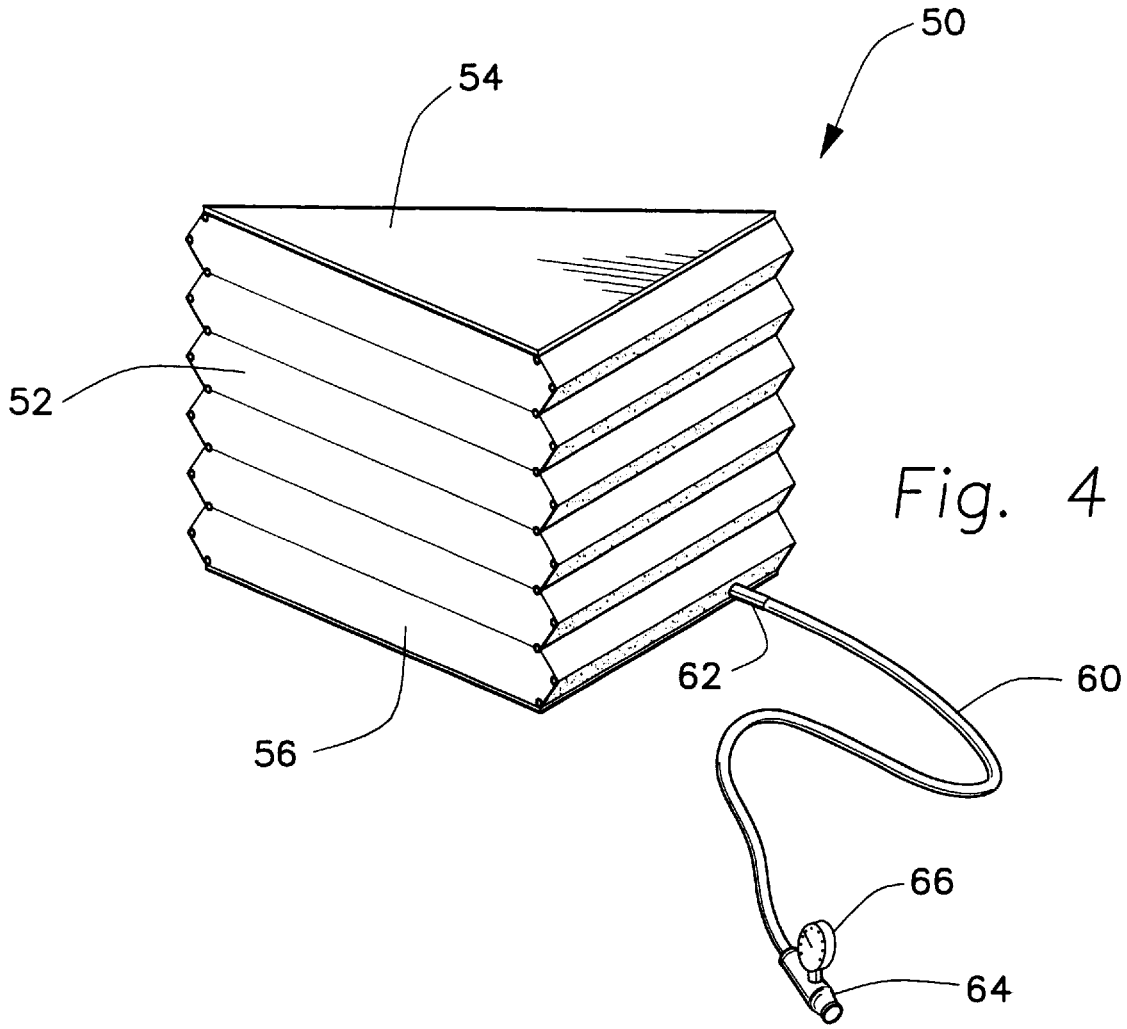
FIG. 4 is a perspective, elevational view of an inflatable device, according to the present invention, in an inflated configuration, in an embodiment without a top.
Figure 5:
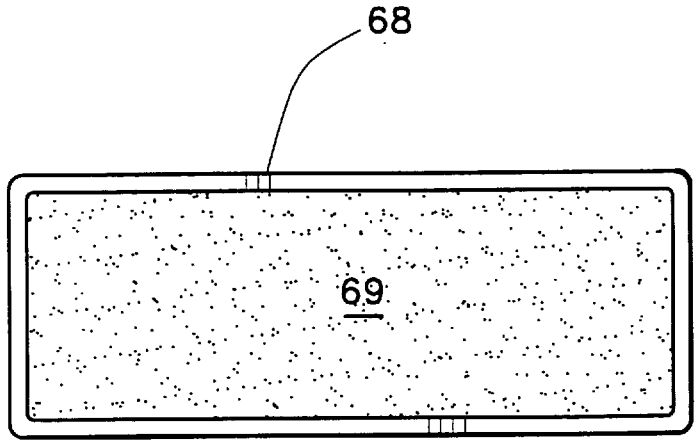
FIG. 5 is a top or bottom plan view of an inflatable device, according to the present invention, in an embodiment without a top.
Figure 7:
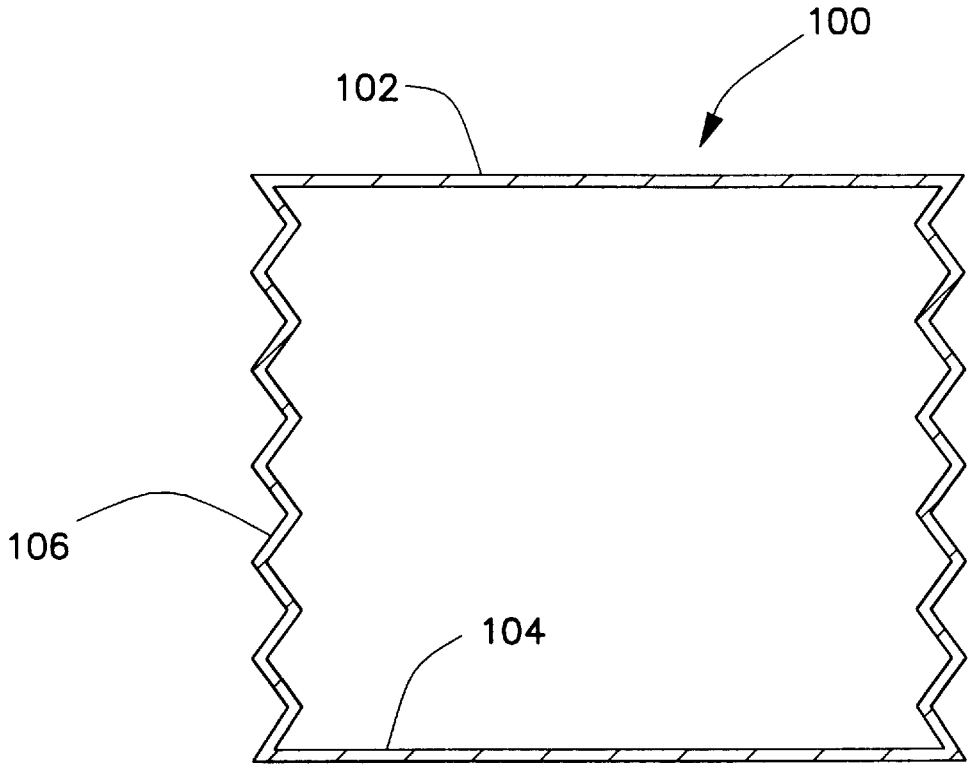
FIG. 7 is a cross-sectional side view of an inflatable device, according to the present invention, in an inflated configuration, in an embodiment without a wire reinforcement.
Figure 8:
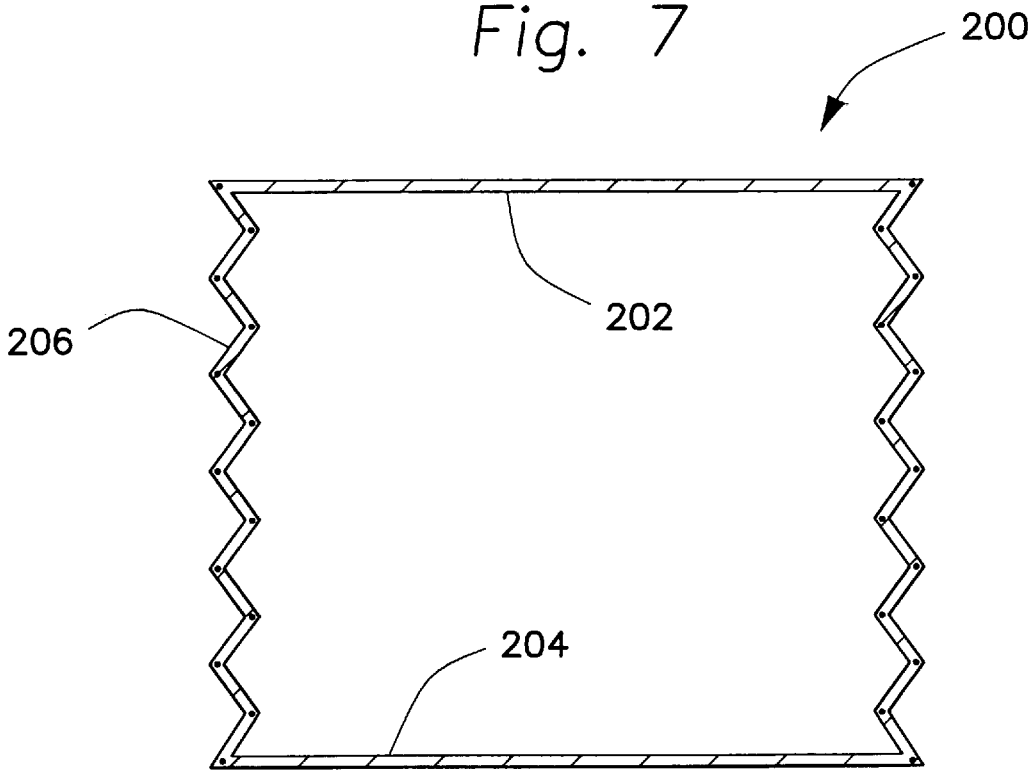
FIG. 8 is a cross-sectional side view of an inflatable device, according to the present invention, in an inflated configuration, in an embodiment with an internal wire reinforcement.

As shown in FIGS. 7 and 8, the middle section 100 comprises a plurality of flexible walls 106. The actual number of flexible walls 106 forming the middle section 100 will depend on the desired end shape and/or size of the inflatable device, since the inflatable device will preferably be manufactured in a variety of shapes and sizes, and used in a variety of different ways. For example, the rectangular-shaped inflatable air device 10 shown in FIGS. 1–3 has four walls, while the triangular-shaped inflatable device 50 shown in FIG. 4 has three walls. To have an equal and even distribution of force applied to a dent, crease, or other surface irregularity by the first surface 102 of the inflatable air vessel 100, as well as provide for an equal and even expansion of the inflatable air vessel 100, it is preferred that all of the walls 106 have accordion-like flexibility. The walls 106 expand or contract in a longitudinal axis between the first surface 102 of the inflatable air vessel 100 and the second surface 104 of the inflatable air vessel 100. Each of the walls 106 has an outer surface and an inner surface. The surfaces of the walls, having an accordion-like flexibility, form a plurality of folds. These folds have a plurality of inward creases and a plurality of outward creases. Each of the inward creases has an inner surface, an outer surface, a first end, and a second end. Also, each of the outward creases also has an inner surface, an outer surface, a first end, and a second end. As shown in FIG. 3, it is preferred that the attachment opening 13 of the inflatable air vessel 10 is defined at the middle section 13, towards the second surface of the inflatable air vessel 10.

As depicted in FIGS. 1–3, the air hose assembly 20 includes an air hose 20 and an air hose coupler 24. Preferably the air hose 20 is about three to five feet long. The air hose 20 has a first end 22 and a second end. The first end 22 of the hose 20 is adapted for attaching to the attachment opening 13 of the inflatable air vessel 10. The second end of the hose 20 is attached to a coupler 24. The coupler 24 also has a first end and a second end. The first end of the coupler is attached to the second end of the air hose 20. The second end of the coupler 24 is adapted for attaching to a suitable pressurized air source (not shown) for inflating the middle section 12. The second end of the coupler 24 may be disconnected from the pressurized air source and may be opened in the usual manner to deflate the middle section 12. The middle section 12 may then be contracted by pressing the first and second surfaces 14,16 of the inflatable air vessel 10 toward one another, and then stored away for future use.

In order to have an inflatable air device 10 that is simple to use and easily measured, it is preferred that the assembly 10 also include a measuring device 26 to measure the air under pressure that will be introduced into or withdrawn from the inflatable air vessel 10. The measuring device 26 may be attached to the the air hose assembly 20 in a typical manner well known in the art. The measuring device 26 is preferably attached to the coupler 24 such that one can introduce or withdraw pressurized air into, or from, the inflatable air vessel 10 at the second end of the coupler 24, while also permitting easy measurement of the amount of pressurized air being introduced into or withdrawn from the inflatable air vessel 10.

To form a simple, time-efficient, and safe device that can accomplish the purposes of the invention, it is preferred that the inflatable air vessel 10 be manufactured as a one-piece unit and that the air hose assembly 20 be attached to the inflatable air vessel 10 by a methods well known in the art. To form an effective device that can accomplish the purposes of the invention, it is preferred that the first and second surfaces 14,16, respectively, of the inflatable air vessel 10, have greater strength, greater rigidity, and less flexibility than the walls of the inflatable air vessel 10.

Figure 6A:
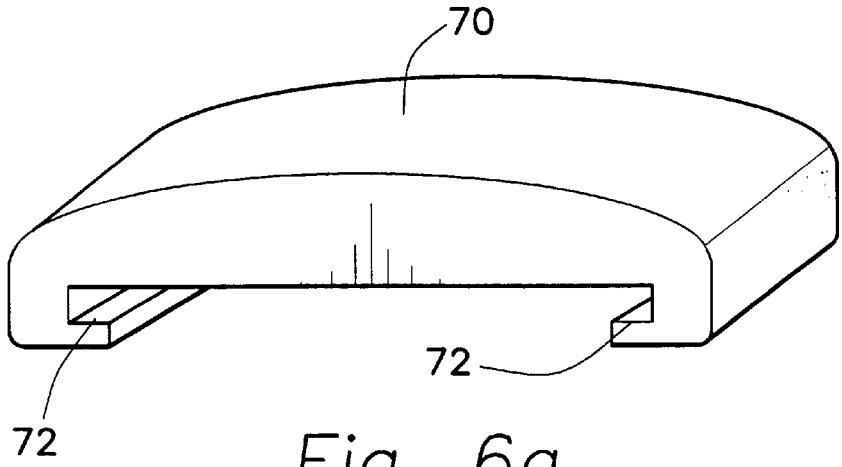
FIG. 6*a* is an elevational view of a top of an inflatable device, according to the present invention, wherein the top is configured in the form of a crown-like shape.
Figure 6B:
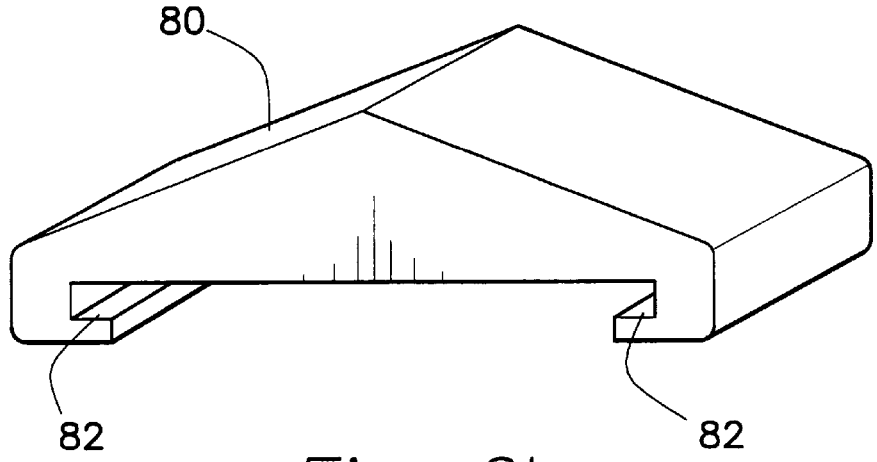
FIG. 6*b* is an elevational view of a top of an inflatable device, according to the present invention, wherein the top is configured in the form of a pointed shape.
Figure 6C:
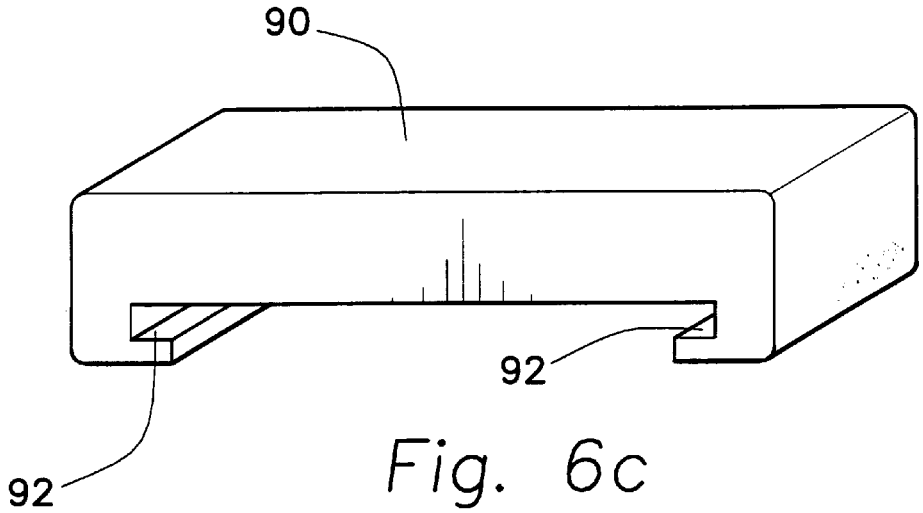
FIG. 6*c* is an elevational view of the top of an inflatable device, according to the present invention, wherein the top is configured in the form of a box-like shape.

An additional embodiment of the current invention comprises the attachment of a separate top portion 18 to the first surface 14. In circumstances where a dent, crease, or other surface irregularity 40 or, alternatively, an object, has a sharp, more defining feature, or a certain shape that requires the invention to have a surface with greater strength, greater rigidity, or greater shape variability than that possessed by the first surface 14 of the inflatable air vessel 10, it is preferred that the separate top portion 18 be manufactured of hard plastic, hard rubber, metal, or the like. This top portion 18 can be manufactured in a variety of shapes and sizes to accommodate the variety of circumstances that can arise in order for the purposes of this invention to be accomplished. It is preferred that the top portion 18 has a similar shape to that of the inflatable air vessel 10. As depicted in FIGS. 6*a*, 6*b*, and 6*c*, the top portions 70,80,90 each have a single or plurality of top surfaces, a bottom surface, and a plurality of sides conforming to the shape of the top portion 70,80,90. The bottom surface of the top portion 70,80,90 has a groove 72,82,92 adapted for attaching to the tongue formation of the first surface 14 of the inflatable air vessel 10. To attach the top portion 70,80,90 to the first surface 14 of the inflatable air vessel 10, the tongue formation of the first surface 14 of the inflatable air vessel 10 can be slid into the groove 72,82,92 of the bottom surface of the top portion 70,80,90.

Figure 9:
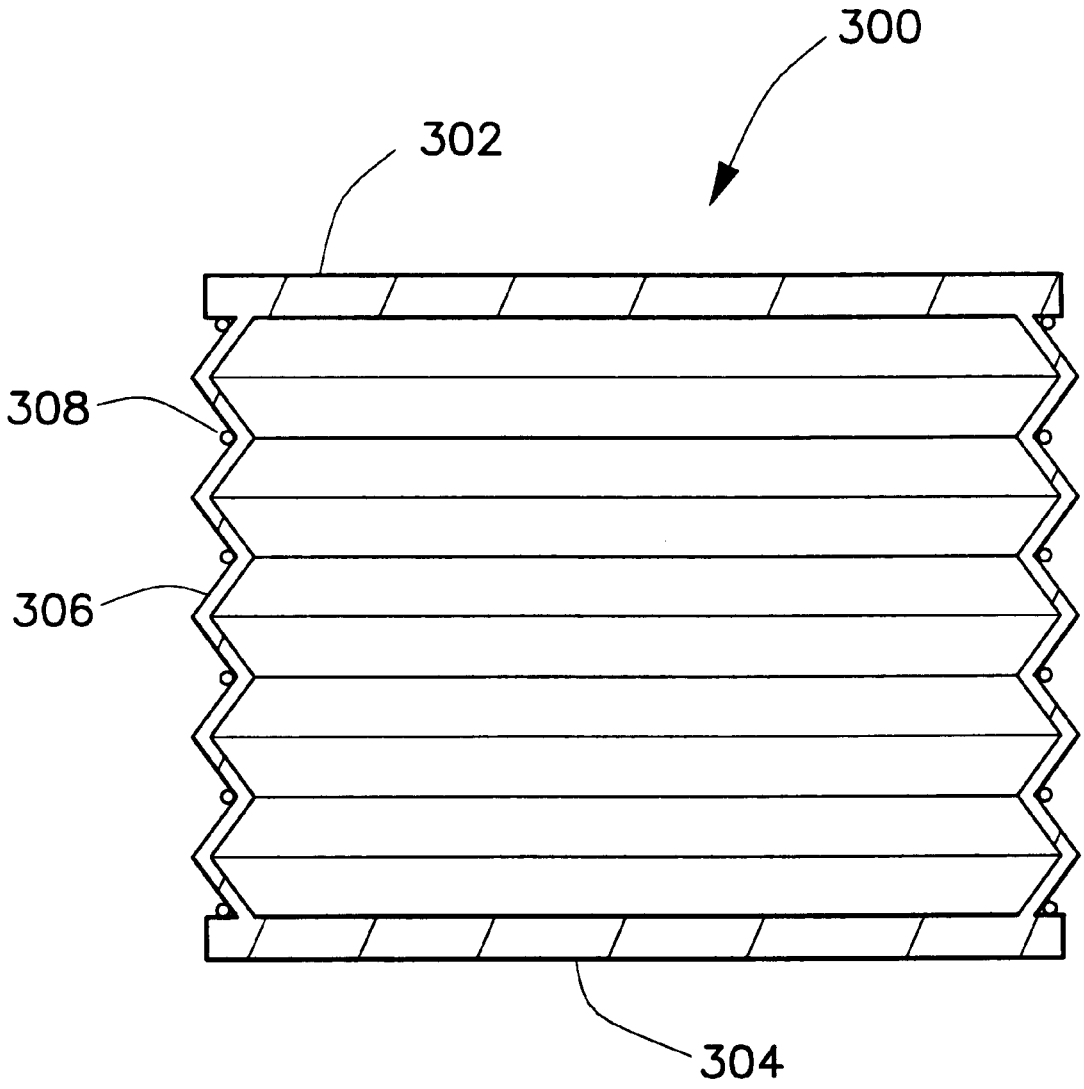
FIG. 9 is a cross-sectional side view of an inflatable device, according to the present invention, in an inflated configuration, in an embodiment with an external wire reinforcement.

In order to help avoid occasional blowouts at the middle section 12 of the inflatable air vessel 10 that may occur, such as by the introduction of excessive amount of pressurized air, it is preferred that each of the inward and outward creases be reinforced with a continuous wire reinforcement, as depicted in FIGS. 8 and 9. The reinforcement wire, of each the inward and outward creases, is preferably located within the layer of suitable resilient material of the middle section 12. The reinforcement wire present in the inward creases is preferably located in a longitudinal axis between the first end of the inward crease and the second end of the inward crease. While the reinforcement wire present in the outward creases is preferably located in a longitudinal axis between the first end of the outward crease and the second end of the outward crease. The longitudinal axis of each of the inward and outward creases is perpendicular to the longitudinal axis between the first surface 14 of the inflatable air vessel 10 and the second surface 16 of the inflatable air vessel 10.

Figure 10:
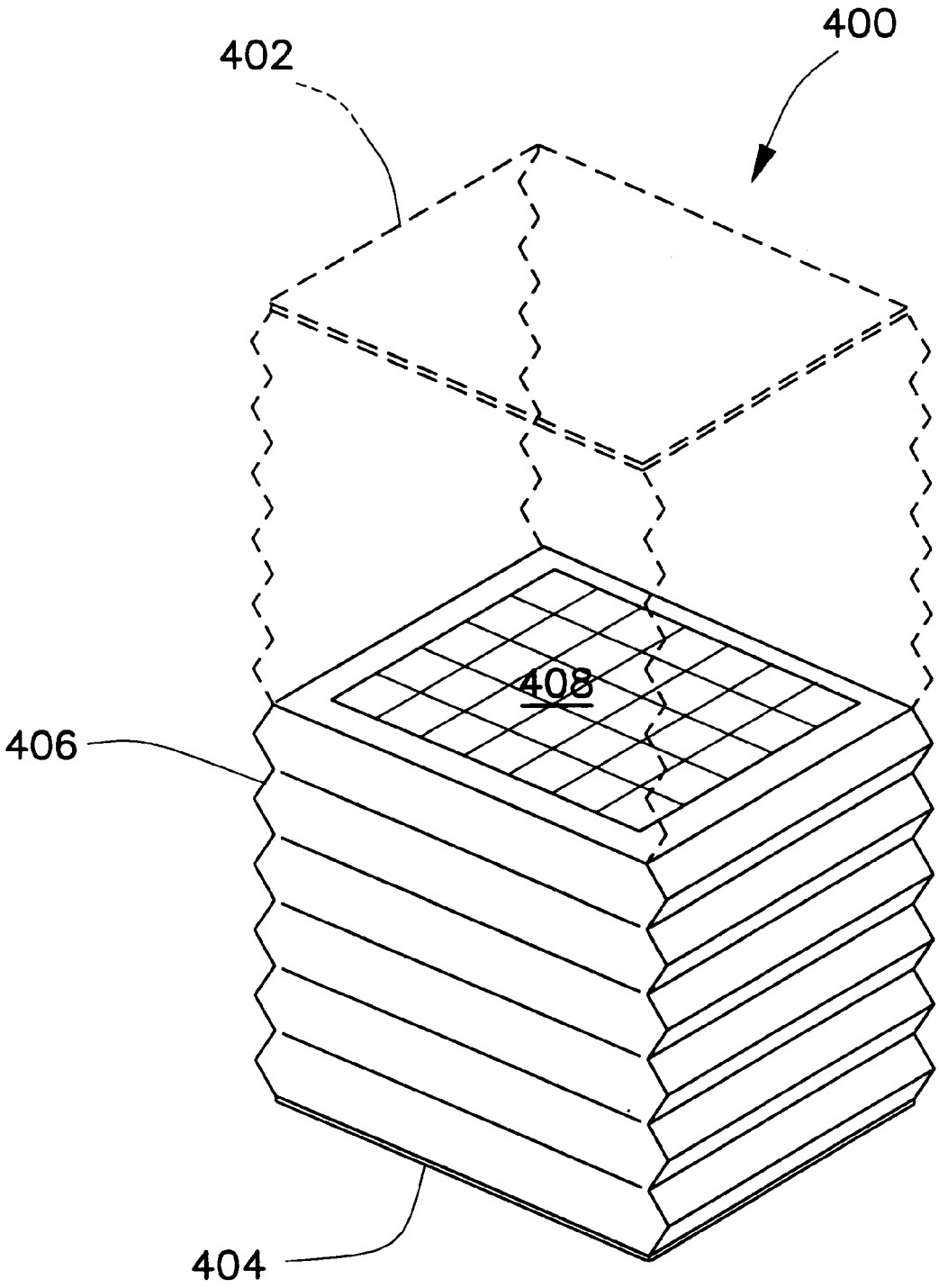
FIG. 10 is a perspective, elevational view of an inflatable device, according to the present invention, in an inflated configuration, in an embodiment with an internal wire mesh reinforcement.

In another embodiment 300, as depicted in FIG. 9, the reinforcement wires 308 reinforce each of the inward creases by being wrapped around and resting on the outer surface of each of the inward creases, like a jewelry ring wrapped around a finger of a person wearing the ring. The reinforcement wires 308 present in the inward creases are preferably located in a longitudinal axis between the first end of each of the inward creases and the second end of each of the inward creases. The longitudinal axis of each inward creases is also perpendicular to the longitudinal axis between the first surface of the inflatable air vessel and the second surface of the inflatable air vessel. In another embodiment 400, as depicted in FIG. 10, an interspersed wire mesh layer 408 is inserted within the inflatable air vessel 400. The mesh layer 408 is preferably located between opposing creases of each of the walls of the inflatable air vessel. 400.

It is to be understood that the present invention is not limited to the sole embodiments described above, but encompasses any and all embodiments within the scope of the following claims.

I claim:

1. An inflatable device for removing a dent, crease, or other surface irregularity in a component of a vehicle said device comprising:

(a) an accordion-like, inflatable air vessel of one-piece construction said vessel having a first planar end surface, a second planar end surface, an accordion-like middle section, and an attachment opening in the middle section adjacent said second end surface;

wherein said first end surface of said vessel comprises a layer of material having sufficient strength and rigidity to press forcefully against a dent, crease, or other surface irregularity when sufficient air under pressure is introduced into said vessel, and wherein said first end surface of said vessel has a tongue formation for attaching a separate top portion;

wherein said second end surface of said vessel comprises a layer of material having sufficient strength and rigidity to press forcefully against an unyielding member in said vehicle when sufficient air under pressure is introduced into said vessel;

wherein said middle section, said first end surface and said second end surface of said vessel are coaxially arranged, said middle section having a plurality of flexible walls having accordion-like flexibility, each of said walls having an outer surface and an inner surface, said surfaces of each of said walls having accordion-like flexibility forming a plurality of folds, said plurality of folds having a plurality of inward creases and a plurality of outward creases, each of said inward creases having an inner surface, an outer surface, a first end, and a second end, each of said outward creases having an inner surface, an outer surface, a first end, and a second end, each of said walls expanding or contracting along a longitudinal axis between said first end surface of said vessel and said second end surface of said vessel;

(b) means for introducing air under pressure into said vessel, said means for introducing air under pressure having a first and a second end, said first end of said means for introducing air under pressure being adapted for attaching to said attachment opening in the middle section of said vessel, said second end of said means for introducing air under pressure being adapted for attaching to an air under pressure source; and (c) means for attaching said opening of said vessel to said means for introducing air under pressure.

2. The device according to claim 1, wherein said vessel is formed of a vulcanized rubber composition.

3. The device according to claim 1 further comprising an air under pressure measuring device, said measuring device being adapted for attaching to means for introducing air under pressure.

4. The device according to claim 1, wherein said means for introducing air under pressure is an air hose assembly comprising an air hose and an air hose coupler;

said hose having a first end and a second end, said first end of said hose adapted for attaching to said opening of said vessel, and said second end of said hose being attached to said coupler; and, said coupler having a first end and a second end, said first end of said coupler being attached to said second end of said hose, said second end of said coupler being adapted for attaching to said air under pressure source.

5. The device according to claim 1, further comprising a top portion having a top surface, a bottom surface, and a plurality of sides; wherein said bottom surface of said top portion has a groove for attaching to said tongue formation of said first end surface of said vessel.

6. The device according to claim 5, wherein said top portion is formed of hard plastic.

7. The device according to claim 1, wherein each of said inward and outward creases are reinforced with a continuous wire reinforcement; and said wire reinforcement defined within said layer of said resilient material of said middle section in a longitudinal axis between said first end of said inward crease and said second end of inward crease, and in a longitudinal axis between said first end of said outward crease and said second end of said outward crease;

wherein said longitudinal axis of each of said inward and outward creases is perpendicular to said longitudinal axis between said first surface of said vessel and said second surface of said vessel.

8. The device according to claim 1, wherein each of said inward creases is reinforced with a continuous wire reinforcement; and said wire reinforcement in each of said inward creases is defined by a longitudinal axis between said first end of said inward crease and said second end of inward crease;

wherein said longitudinal axis of each of said inward creases is perpendicular to said longitudinal axis between said first surface of said vessel and said second surface of said vessel.

* * * * *